US006604921B1

(12) United States Patent
Plop et al.

(10) Patent No.: US 6,604,921 B1
(45) Date of Patent: Aug. 12, 2003

(54) OPTIMIZED LINER THICKNESS FOR POSITIVE DISPLACEMENT DRILLING MOTORS

(75) Inventors: Andrei N. Plop, Houston, TX (US); Vernon E. Koval, Rosenberg, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/056,135

(22) Filed: Jan. 24, 2002

(51) Int. Cl.[7] ..... F01C 1/10
(52) U.S. Cl. ..... 418/48; 418/178; 418/153
(58) Field of Search ..... 418/48, 178, 153

(56) References Cited

U.S. PATENT DOCUMENTS

| | | | |
|---|---|---|---|
| 3,417,664 | A | 12/1968 | Brucker |
| 4,104,009 | A | 8/1978 | Chanton |
| 4,173,670 | A | 11/1979 | VanAuken |
| 4,676,725 | A | 6/1987 | Eppink |
| 4,836,759 | A | 6/1989 | Lloyd |
| 4,863,359 | A | 9/1989 | Unterstrasser et al. |
| 5,145,343 | A | 9/1992 | Belcher |
| 5,171,138 | A | 12/1992 | Forrest |
| 5,318,416 | A | 6/1994 | Hantschk et al. |
| 5,358,390 | A | 10/1994 | Jäger |
| 5,759,019 | A | 6/1998 | Wood et al. |
| 6,019,583 | A | 2/2000 | Wood |
| 6,035,899 | A | 3/2000 | Ohkoshi et al. |
| 6,102,681 | A | 8/2000 | Turner |
| 6,120,267 | A | 9/2000 | Cunningham |
| 6,158,988 | A | 12/2000 | Jager |
| 6,162,032 | A | 12/2000 | Jäger |
| 6,183,226 | B1 | 2/2001 | Wood et al. |
| 6,241,494 | B1 | 6/2001 | Pafitis et al. |
| 6,293,358 | B1 | 9/2001 | Jäger |
| 6,309,195 | B1 | 10/2001 | Bottos et al. |
| 2001/0005486 | A1 | 6/2001 | Wood |

FOREIGN PATENT DOCUMENTS

| | | | | |
|---|---|---|---|---|
| DE | 2017620 | * | 4/1970 | ..... 418/48 |
| DE | 2713468 | * | 9/1978 | ..... 418/48 |
| DE | 4006339 | * | 8/1991 | ..... 418/48 |
| WO | WO 98/40273 | | 10/1997 | |
| WO | WO 99/31389 | | 6/1999 | |
| WO | WO 99/63226 | | 12/1999 | |

* cited by examiner

*Primary Examiner*—Thomas Denion
*Assistant Examiner*—Theresa Trieu
(74) *Attorney, Agent, or Firm*—J. L. Jennie Salazar; Brigitte L. Jeffery

(57) ABSTRACT

A stator for a positive displacement motor including an external tube. The external tube includes an outer surface and an inner surface, and the inner surface includes at least two radially inwardly projecting lobes extending helically along a length of the external tube. A liner is positioned adjacent the inner surface, and the liner conforms to the radially inwardly projecting lobes formed on the inner surface and to the helical shape of the inner surface. A thickness of the liner is at a maximum at the at least two radially inwardly projecting lobes.

15 Claims, 2 Drawing Sheets

OPTIMIZED LINER THICKNESS FOR POSITIVE DISPLACEMENT DRILLING MOTORS

BACKGROUND OF INVENTION

1. Field of the Invention

The invention relates generally to stators for use with positive displacement drilling motors. More specifically, the invention relates to selecting an optimized liner thickness for a stator so as to increase the power available from a positive displacement motor while increasing longevity of the stator.

2. Background Art

Positive Displacement Motors (PDMs) are known in the art and are commonly used to drill wells in earth formations. PDMs operate according to a reverse mechanical application of the Moineau principle wherein pressurized fluid is forced though a series of channels formed on a rotor and a stator. The channels are generally helical in shape and may extend the entire length of the rotor and stator. The passage of the pressurized fluid generally causes the rotor to rotate within the stator. For example, a substantially continuous seal may be formed between the rotor and the stator, and the pressurized fluid may act against the rotor proximate the sealing surfaces so as to impart rotational motion on the rotor as the pressurized fluid passes through the helical channels.

Referring to FIG. 1, a typical rotor 10 includes at least one lobe 12 (wherein, for example, channels 14 are formed between lobes 12), a major diameter 8, and a minor diameter 6. The rotor 10 may be formed of metal or any other suitable material. The rotor 10 may also be coated to withstand harsh drilling environments experienced downhole. Referring to FIG. 2, a typical stator 20 comprises at least two lobes 22, a major diameter 7, and a minor diameter 5. Note that if the rotor (10 in FIG. 1) includes "n" lobes, the corresponding stator 20 used in combination with the rotor 10 generally includes either "n+1" or "n−1" lobes. Referring to FIG. 3, the stator 20 generally includes a cylindrical external tube 24 and a liner 26. The liner 26 may be formed from an elastomer, plastic, or other synthetic or natural material known in the art. The liner 26 is typically injected into the cylindrical external tube 24 around a mold (not shown) that has been placed therein. The liner 26 is then cured for a selected time at a selected temperature (or temperatures) before the mold (not shown) is removed. A thickness 28 of the liner 26 is generally controlled by changing the dimensions of the mold (not shown).

A lower end of the rotor may be coupled either directly or indirectly to, for example, a drill bit. In this manner, the PDM provides a drive mechanism for a drill bit independent of any rotational motion of a drillstring generated proximate the surface of the well by, for example, rotation of a rotary table on a drilling rig. Accordingly, PDMs are especially useful in drilling directional wells where a drill bit is connected to a lower end of a bottom hole assembly (BHA). The BHA may include, for example, a PDM, a transmission assembly, a bent housing assembly, a bearing section, and the drill bit. The rotor may transmit torque to the drill bit via a drive shaft or a series of drive shafts that are operatively coupled to the rotor and to the drill bit. Therefore, when directionally drilling a wellbore, the drilling action is typically referred to as "sliding" because the drill string slides through the wellbore rather than rotating through the wellbore (as would be the case if the drill string were rotated using a rotary table) because rotary motion of the drill bit is produced by the PDM. However, directional drilling may also be performed by rotating the drill string and using the PDM, thereby increasing the available torque and drill bit rpm.

A rotational frequency and, for example, an amount of torque generated by the rotation of the rotor within the stator may be selected by determining a number of lobes on the rotor and stator, a major and minor diameter of the rotor and stator, and the like. An assembled view of a rotor and a stator is shown in FIG. 3. Rotation of the rotor 10 within the stator 20 causes the rotor 10 to nutate within the stator 20. Typically, a single nutation may be defined as when the rotor 10 moves one lobe width within the stator 20. The motion of the rotor 10 within the stator 20 may be defined by a circle O which defines a trajectory of a point A disposed on a rotor axis as point A moves around a stator axis B during a series of nutations. Note that an "eccentricity"e of the assembly may be defined as a distance between the rotor axis A and the stator axis B when the rotor 10 and stator 20 are assembled to form a PDM.

Typical stators known in the art are formed in a manner similar to that shown in FIG. 2. Specifically, an inner surface 29 of the external tube 24 is generally cylindrical in shape and the stator lobes 22 are formed by molding an elastomer in the external tube 24. Problems may be encountered with the stator 20 when, for example, rotation of the rotor 10 within the stator 20 shears off portions of the stator lobes 22. This process, which may be referred to as "chunking," deteriorates the seal formed between the rotor 10 and stator 20 and may cause failure of the PDM. Chunking may be increased by swelling of the liner 26 or thermal fatigue. Swelling and thermal fatigue may be caused by elevated temperatures and exposure to certain drilling fluids and formation fluids, among other factors. Moreover, flexibility of the liner 26 may lead to incomplete sealing between the rotor 10 and stator 20 such that available torque may be lost when the rotor compresses the stator lobe material, thereby reducing the power output of the PDM. Accordingly, there is a need for a stator design that provides increased power output and increased longevity in harsh downhole environments.

SUMMARY OF INVENTION

In one aspect, the invention comprises a stator for a positive displacement motor. The stator comprises an external tube comprising an outer surface and an inner surface, and the inner surface comprising at least two radially inwardly projecting lobes extending helically along a selected length of the external tube. A liner is disposed proximate the inner surface, and the liner conforms to the radially inwardly projecting lobes formed on the inner surface and to the helical shape of the inner surface. A thickness of the liner is at a maximum proximate the at least two radially inwardly projecting lobes.

In another aspect, the invention comprises a positive displacement motor. The positive displacement motor comprises a stator including an external tube comprising an outer surface and an inner surface. The inner surface comprises at least two radially inwardly projecting lobes extending helically along a selected length of the external tube. A liner is disposed proximate the inner surface, and the liner conforms to the radially inwardly projecting lobes formed on the inner surface and to the helical shape of the inner surface. A thickness of the liner is at a maximum proximate the at least two radially inwardly projecting lobes. A rotor is disposed inside the stator, and the rotor comprises at least one radially outwardly projecting lobe extending helically along a selected length of the rotor. The at least one radially outwardly projecting lobe formed on the rotor is adapted to sealingly engage the at least two radially outwardly projecting lobes formed on the liner.

Other aspects and advantages of the invention will be apparent from the following description and the appended claims.

DETAILED DESCRIPTION

Figure 4:
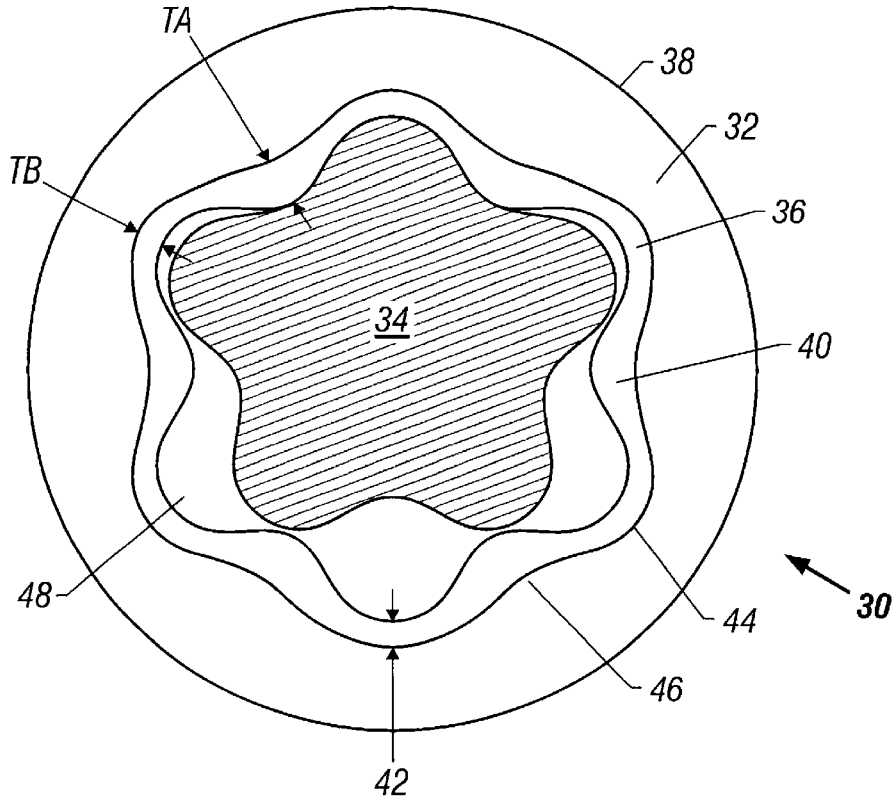
FIG. 4 shows a cross-sectional view of an embodiment of the invention.

FIG. 4 shows an embodiment comprising at least one aspect of the present invention, A positive displacement motor (PDM) 30 comprises a stator 32 and a rotor 34. The stator 32 comprises an external tube 38 that may be formed from, for example, steel or another material suitable for downhole use in a drilling environment. The stator also comprises a liner 36 that may be formed from an elastomer, a plastic, or any other suitable synthetic or natural material known in the art. In some embodiments, the liner may also be formed from a fiber reinforced material such as the materials described in co-pending U.S. patent application Ser. No. 10/097,480, and assigned to the assignee of the present application.

The external tube 38 comprises a shaped inner surface 44 that comprises at least two lobes 46 formed thereon. The lobes 46 are helically formed along a selected length of the external tube 38 so that the lobes 46 define a helical pattern along the selected length. The helical form of the inner surface 44 generally corresponds to a desired shape for stator lobes. The liner 36 typically comprises at least two lobes 40, and a thickness 42 of the liner 36 is non-uniform throughout a cross-section thereof. The lobes 40 (and the liner 36) are helically formed along a selected length of the external tube 38 such that the liner 36 conforms to the helically shaped inner surface 44 so that the at least two lobes 46 formed on the shaped inner surface 44 correspond to the lobes 40 formed in the liner 36. The external tube 38, including the inner surface 44, may be helically shaped by any means known in the art including machining, extrusion, and the like.

In some embodiments, the shaped inner surface 44 of the external tube 38 is adapted to provide additional support for the liner material. The shaped inner surface 44 "stiffens" the liner 36 by providing support for the liner 36 (e.g., by forming a metal backing), thereby increasing power available from the PDM. For example, shaping the inner surface 44 to form a contoured backing for the liner 36 may stiffen the liner material proximate the lobes 40 by reducing an amount by which the liner 36 may be compressed when contacted by the rotor 44 so that a better seal may be formed between the rotor 44 and the stator 32. Moreover, reduced flexibility increases an amount of torque required to stall the PDM.

Figure 1:
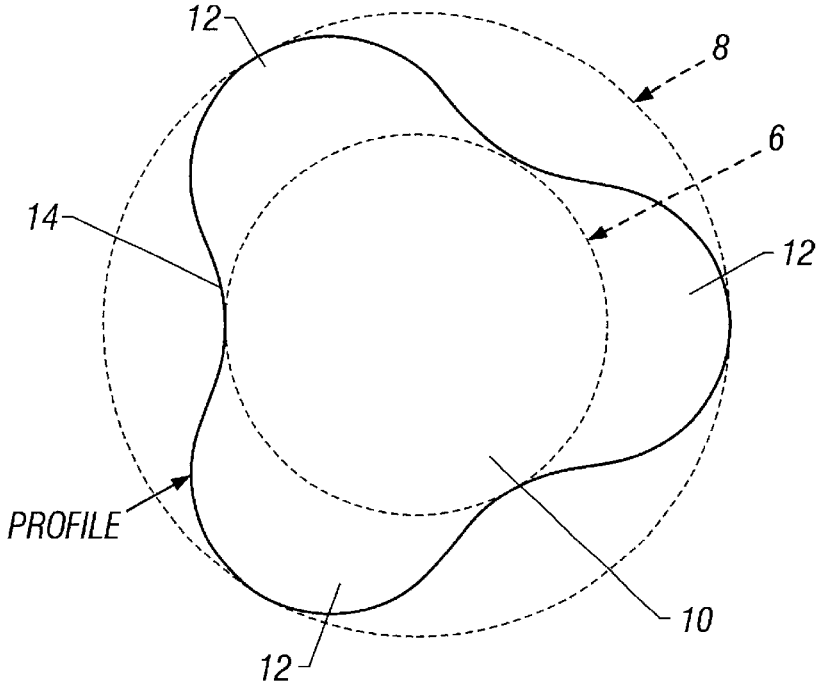
FIG. 1 (Prior Art)
FIG. 1 shows a prior art rotor.
Figure 2:
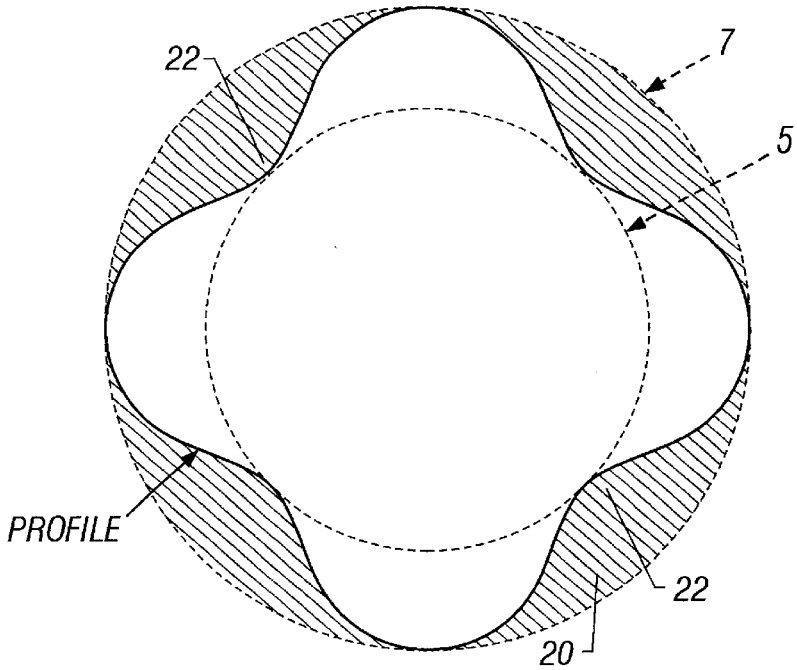
FIG. 2 (Prior Art)
FIG. 2 shows a prior art stator.
Figure 3:
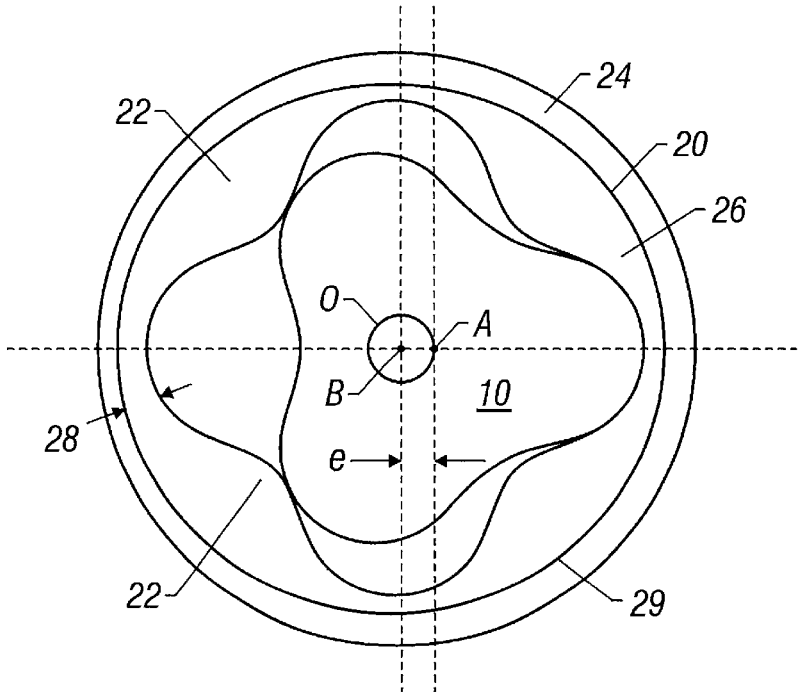
FIG. 3 (Prior Art)
FIG. 3 shows an assembled view of a prior art positive displacement motor.

The thickness 42 of the liner 36 may be increased at selected locations that are exposed to, for example, increased wear and shear (e.g., proximate the lobes 40, 46), so that the longevity of the stator 32 and, therefore, the longevity of the PDM 30 may be increased. In some embodiments, the thickness of the liner 36 is selected so as to maximize a shear strength of the liner 36 proximate the lobes 46 The shaped form of the inner surface 44 typically results in a thinner liner 36 than is commonly used in prior art stators (such as that shown in FIG. 3). Fluid pressure is less likely to deform the liner 36 and, accordingly, the liner 36 is less susceptible to deformation that could reduce the efficiency of the seal formed between de rotor 34 and stator 32 (thereby producing an additional loss in power output of the PDM 30).

As shown in FIG. 4, the thickness 42 of the liner 36 may be varied so that a thickness TA of the portion of the liner 36 proximate the lobes 46 is greater than a thickness of other portions of the liner 36 (e.g., a thickness TB of the portion of the liner 36 proximate channels 48). The thickness 42 of the liner 36 may be selected to generate a desired amount of contact (or, if desired, clearance) between the liner 36 and the rotor 34. For example, the thickness 42 of the liner 36 may be selected to form a seal between the rotor 34 and the stator 32 while maintaining a desired level of compression between the rotor 34 and stator 32 when they are in contact with each other. Moreover, the thickness 42 of the liner 36 may be selected to permit, for example, swelling or contraction of the liner 36 caused by elevated temperatures, contact with drilling fluids and other fluids, and the like.

In some embodiments, the thickness TA of the liner 36 proximate the lobes 46 is selected to be at least 1.5 times the thickness TB of the liner 36 proximate the channels 48. In other embodiments, the thickness TA of the liner 36 proximate the lobes 46 may be selected to be less than or equal to 3 times the thickness TB of the liner 36 proximate the channels 48. Other embodiments may comprise other thickness ratios depending on the type of material (e.g., elastomer, plastic, etc.) selected to form the liner 36.

Note that the embodiment in FIG. 4 is generally referred to as a "5:6" configuration including 5 lobes formed on the rotor and 6 lobes formed on the stator. Other embodiments may include any other rotor/stator combination known in the art, including 1:2, 3:4, 4:5, 7:8, and other arrangements. Moreover, as described above, stators may generally be formed using "n+1" or "n−1" lobes, where "n" refers to a number of rotor lobes. Accordingly, the embodiment shown in FIG. 4, and other embodiments described herein, are intended to clarify the invention and are not intended to limit the scope of the invention with respect to, for example, a number of or arrangement of lobes.

Accordingly, the present invention allows for an inner surface of an external stator tube to be shaped so as to enable optimization of a liner thickness and to provide a stiff backing for the liner material. Optimizing liner thickness leads to increased power output and increased longevity of the power section.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A stator for a positive displacement motor comprising:

an external tube comprising an outer surface and an inner surface, the inner surface comprising at least two radially inwardly projecting lobes extending helically along a selected length of the external tube; and a liner disposed proximate the inner surface, the liner conforming to the radially inwardly projecting lobes formed on the inner surface and to the helical shape of the inner surface, wherein a thickness of the liner is at a maximum proximate the at least two radially inwardly projecting lobes.

2. The stator of claim 1, wherein a thickness of the liner is selected to form a desired level of compression between the liner and a rotor.

3. The stator of claim 1, wherein a thickness of the liner is selected to maximize a shear strength of the liner proximate the at least two radially inwardly projecting lobes.

4. The stator of claim 1, wherein a thickness of the liner is selected so as to maximize a power output of a positive displacement motor.

5. The stator of claim 1, wherein the inner surface is shaped so as to reduce an amount of fluid pressure deformation of the liner.

6. The stator of claim 1, wherein a thickness of the liner proximate the at least two radially inwardly projecting lobes is at least 1.5 times a thickness of the liner proximate channels formed between the at least two radially inwardly projecting lobes.

7. The stator of claim 1, wherein a thickness of the liner proximate the at least two radially inwardly projecting lobes is less than or equal to 3 times a thickness of the liner proximate channels formed between the at least two radially inwardly projecting lobes.

8. A positive displacement motor comprising:

a stator comprising an external tube comprising an outer surface and an inner surface, the inner surface comprising at least two radially inwardly projecting lobes extending helically along a selected length of the external tube, and a liner disposed proximate the inner surface, the liner conforming to the radially inwardly projecting lobes formed on the inner surface and to the helical shape of the inner surface, wherein a thickness of the liner is at a maximum proximate the at least two radially inwardly projecting lobes; and a rotor disposed inside the stator, the rotor comprising at least one radially outwardly projecting lobe extending helically along a selected length of the rotor, the at least one radially outwardly projecting lobe formed on the rotor adapted to sealingly engage the at least two radially outwardly projecting lobes formed on the liner.

9. The positive displacement motor of claim 8, wherein a thickness of the liner is selected to form a desired level of compression between the liner and a rotor.

10. The positive displacement motor of claim 8, wherein a thickness of the liner is selected to maximize a shear strength of the liner proximate the at least two radially inwardly projecting lobes.

11. The positive displacement motor of claim 8, wherein a thickness of the liner is selected so as to maximize a power output of the positive displacement motor.

12. The positive displacement motor of claim 8, wherein the inner surface is shaped so as to reduce an amount of fluid pressure deformation of the liner.

13. The positive displacement motor of claim 8, wherein the inner surface is shaped so as to maximize a power output of the positive displacement motor.

14. The positive displacement motor of claim 8, wherein a thickness of the liner proximate the at least two radially inwardly projecting lobes is at least 1.5 times a thickness of the liner proximate channels formed between the at least two radially inwardly projecting lobes.

15. The positive displacement motor of claim 8, wherein a thickness of the liner proximate the at least two radially inwardly projecting lobes is less than or equal to 3 times a thickness of the liner proximate channels formed between the at least two radially inwardly projecting lobes.

* * * * *

(12) SUPPLEMENTAL EXAMINATION CERTIFICATE

United States Patent (10) Number: 6,604,921 F1

Plop et al. (45) Certificate Issued: Aug. 28, 2014

Control No.: 96/000,065 Filing Date: Aug. 7, 2014

Primary Examiner: William C. Doerrler

No substantial new question of patentability is raised in the request for supplemental examination. See the Reasons for Substantial New Question of Patentability Determination in the file of this proceeding.

(56) Items of Information

U.S. PATENT DOCUMENTS

| | | |
|---|---|---|
| 6,309,195 | 10/2001 | Bottos et al. |
| 5,417,281 | 5/1995 | Wood et al. |

FOREIGN PATENT DOCUMENTS

| | | |
|---|---|---|
| DE | 2017620 | 11/4/1971 |
| WO | 00/29750 | 5/25/2000 |
| WO | 01/44615 A2 | 6/21/2000 |
| DE | 20013030 U1 | 12/7/2000 |
| DE | 19950258 A1 | 4/26/2001 |

OTHER DOCUMENTS

USPTO Office Action dated January 10, 2003 from the prosecution history of the '921 Patent Reply under 37 1.111 dated April 8, 2003 from the prosection history of the '921 Patent Declaration of Andrei N. Plop, co-inventor of the '921 Patent Declaration of Vernon E. Koval, co-inventor of the '921 Patent